United States Patent [19]

Casey

[11] 4,161,270

[45] Jul. 17, 1979

[54] CONTINUOUS LOOP STUFFER CARTRIDGE HAVING IMPROVED MOEBIUS LOOP TENSIONING DEVICE

[75] Inventor: Ross H. Casey, Meridian, Id.

[73] Assignee: Hewlett-Packard Company, Palo Alto, Calif.

[21] Appl. No.: 815,976

[22] Filed: Jul. 15, 1977

[51] Int. Cl.[2] ..... B65H 17/50; B65H 23/32

[52] U.S. Cl. ..... 226/118; 226/195; 226/197; 400/195; 400/196.1

[58] Field of Search ..... 226/118, 197, 119, 195; 400/195, 196.1; 198/839

[56] References Cited

U.S. PATENT DOCUMENTS

| | | | |
|---|---|---|---|
| 3,125,268 | 3/1964 | Bartholomay | 226/197 X |
| 3,356,275 | 12/1967 | Wright | 226/197 X |
| 3,989,132 | 11/1976 | Carson | 226/197 X |

FOREIGN PATENT DOCUMENTS

| | | | |
|---|---|---|---|
| 1416802 | 12/1975 | United Kingdom | 400/196.1 |

*Primary Examiner*—Bruce H. Stoner, Jr.
*Attorney, Agent, or Firm*—Theodore Scott Park

[57] ABSTRACT

A Ribbon Stuffer Cartridge having improved Moebius loop device includes a ribbon reservoir coupled to a ribbon input port and a ribbon output port, the ribbon output port having a planar triangular-shaped device therein.

A major portion of a continuous loop ribbon is stored within the ribbon reservoir and the remaining portion of the continuous loop ribbon extends from the ribbon output port to the ribbon input port. The Moebius twist is formed by disposing the ribbon about the planar triangular-shaped device positioned within the ribbon output port. Gears are positioned within the input port to move the continuous loop, and the triangular-shaped device additionally serves as a tensioner to provide increased tape tension in the loop as it extends from output port to input port.

9 Claims, 3 Drawing Figures

CONTINUOUS LOOP STUFFER CARTRIDGE HAVING IMPROVED MOEBIUS LOOP TENSIONING DEVICE

BACKGROUND AND SUMMARY

Replaceable ink cartridges employing a continuous loop of inked tape or Mylar ribbon for use with high speed impact printers are known in the art. Typically, a cubically-shaped wire form or a plurality of guides are used to effect a Moebius twist in the continuous loop.

The invention includes an improved Moebius loop device and tensioner in the form of an easily constructed planar triangular-shaped device to effect a Moebius twist and tensioning in a continuous loop. Spring biasing means in combination with the device provides selective tensioning of the continuous loop. A portion of the loop is disposed about a first edge surface of the triangular guide, then about a second edge surface, and then about a third.

The cartridge includes a reservoir coupled to an input port and an output port. A continuous tape is disposed within the reservoir, through the output port, from the output port to the input port, and through the input port to the reservoir. The Moebius device is disposed within the output port to provide increased tension within the portion of the loop disposed between the output port and the input port. The reservoir has nonparallel guides which separate in the direction of tape travel through the reservoir to facilitate tape throughput.

DESCRIPTION OF THE PREFERRED EMBODIMENT

Figure 1:
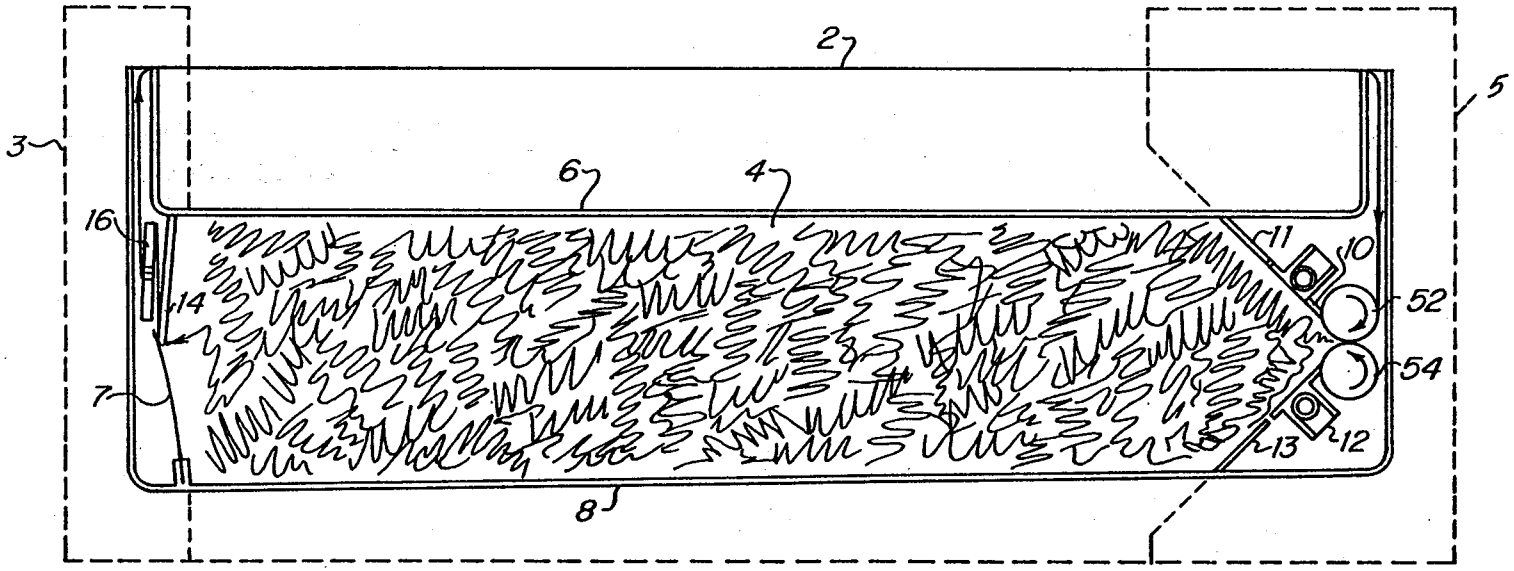
FIG. 1 is a cross-sectional diagram of a preferred Ribbon Stuffer Cartridge constructed in accordance with the invention.

Referring to FIG. 1, a sectional view of a preferred ribbon cartridge is shown. The major portion of a continuous loop ribbon 2 is disposed within a ribbon reservoir 4 having a ribbon input port 5 and a ribbon output port 3. Tape 2 is pulled from the output port 3 towards the input port 5 by ribbon gears 52 and 54, and injected into the ribbon reservoir 4. Peeler guides 10 and 12 are disposed about gears 52 and 54 to assist tape 2 in separating from gears 52 and 54, and reservoir guides 11 and 13 direct the injected tape 2 into the interior of reservoir 4. In operation, the combined effect of rotation of drive gears 52, 54 and peeler guides 10 and 12 causes tape 2 to move into reservoir 4 at approximately 50 inches/sec and to form a mass of spring-like portions of compressed tape 2 in the manner shown in FIG. 1. The spring-like portions provide an internal spring biasing force to the mass of tape 2 within reservoir 4 as tape 2 drifts through the reservoir 4 toward output port 3.

The ribbon reservoir 4 preferably includes nonparallel draft guides 6 and 8, and output guide 14. Nonparallel draft guides 6 and 8 are disposed a varying distance apart from each other, the distance between guides 6 and 8 increasing as tape 2 travels from input port 5 towards output port 3. The draft guides 6 and 8 provide draft to assist the major portion of tape 2 disposed within the reservoir 4 to move toward the output port 3. The varying distance between guides 6 and 8 assists the mass of tape 2 within reservoir 4 to expand and to drift toward output port 3. Guide 14 forms a portion of reservoir 4 and acts as a bearing surface for tape 2 as it enters output port 3.

Figure 2:
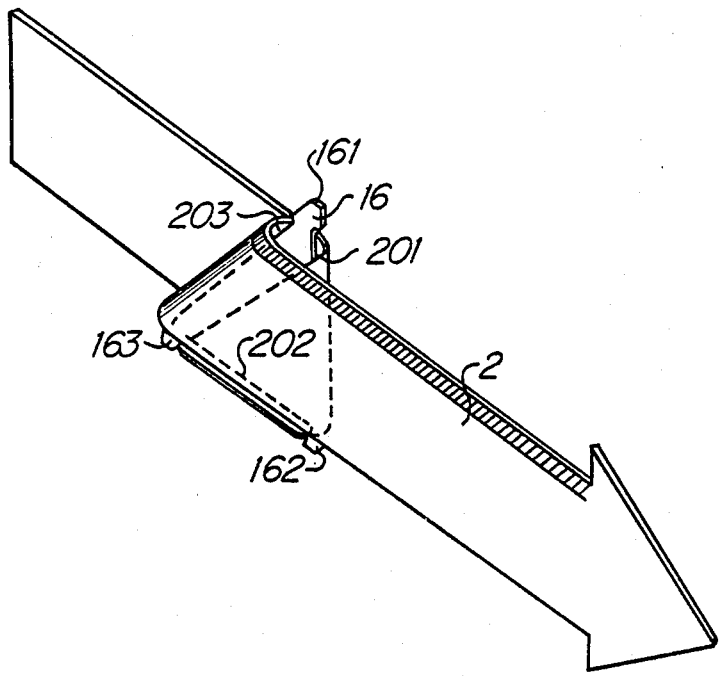
FIG. 2 is an illustration of an improved Moebius loop device in combination with a portion of a continuous tape loop.

Referring to FIG. 1, a novel Moebius loop device 16 is disposed within the output port 3. Tape 2 is biased by output guide 14 as tape 2 passes from the reservoir 4 into output port 3. Tape 2 is then disposed about Moebius loop device 16 as illustrated in FIG. 2 to invert tape 2 and form a Moebius half twist in the continuous tape loop formed by tape 2. The tension in tape 2 is greater as it extends from Moebius device 16 in output port 3 to input port 5, for example, than is the tension in tape 2 as it extends from input port 5 to output port 3 within tape reservoir 4. The greater tension in tape 2 as it travels from port 3 to port 5 is created by gears 52 and 54 pulling tape 2 about Moebius device 16.

Referring to FIG. 1, a tension spring 7 is positioned within output port 3 to provide increased tension within tape 2. The spring creates increased tension within that portion of tape 2 which extends from reservoir 4 to Moebius device 16 which results in increased tension in the portion of tape 2 extending from output port 3 to input port 5. Tension is varied by adjusting the bias of tension spring 7.

Referring to FIG. 2, Moebius device 16 in a preferred combination with tape 2 is illustrated. Moebius device 16 is preferably of a planar shape and has three rounded edge surfaces disposed in a triangular configuration. Tape 2 is disposed about a first edge surface 201, then disposed about a second edge surface 202 adjacent to the first edge surface 201 and then disposed about a third edge surface 203 as illustrated in FIG. 2. The tape 2 shown in FIG. 2 has a shaded edge to illustrate the Moebius half twist in tape 2 effected by device 16.

Figure 3:
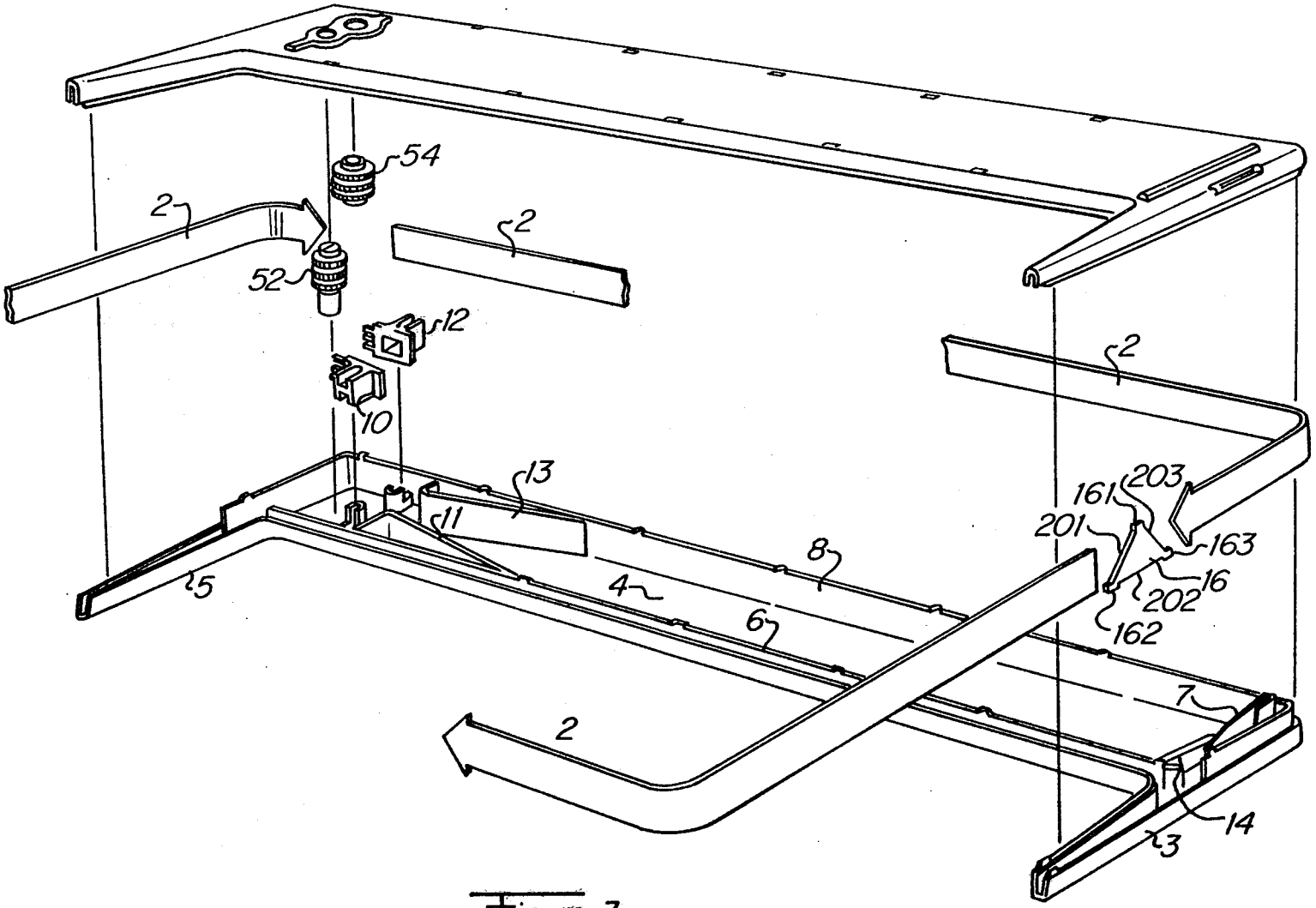
FIG. 3 is an illustration of an expanded preferred embodiment.

Referring to FIGS. 2 and 3, device 16 can be affixed to output port 3 by cementing tabs 161 and 163 to the body of output port 3, for example, or integrally molding device 16 into the cartridge body, or by retaining device 16 within recesses or the like. Sufficient clearance for tape 2 to move about guide surfaces 201, 202, and 203 is provided by tabs 161, 162 and 163.

Device 16 may be fabricated from a single sheet of plastic to form the preferred device 16 illustrated in FIGS. 2 and 3. Device 16 can also be formed, for example, from a wire form or the like.

In operation, the preferred embodiment is positioned, for example, in an impact printer such that a portion of tape 2 between output port 3 and input port 5 is disposed between a record medium and impact elements of the printer. As impact elements of the printer strike the portion of tape 2 against the record medium, tape 2 is moved as required by turning gears 52 and 54.

Although the preferred embodiment has been described with reference to use in combination with printing devices, the invention is also applicable to providing a continuous loop magnetic tape to a tape recorder, intelligent terminal and computer or the like, and other applications including photographic film or videotape cartridges and the like.

I claim:

1. Apparatus comprising:

a reservoir having a capacity for holding tape;

an output port coupled to the reservoir and having an orifice for dispensing tape;

an input port coupled to the reservoir, and having an orifice for receiving tape;

a triangular-shaped tensioning device positioned within the output port, the triangular-shaped tensioning device having three frictional edge surfaces comprising a first edge surface, a second edge surface and a third edge surface, each of the three edge surfaces being substantially disposed within a plane defined by the other two edge surfaces;

a continuous loop tape having a Moebius half twist therein disposed about the first edge surface, the second edge surface and the third edge surface of the triangular-shaped tensioning device and the tape having a portion within the reservoir and a portion extending from the output port to the input port; and tape moving means positioned within the input port for creating a tensile force within the portion of the continuous loop tape disposed outside the reservoir and extending from the triangular-shaped tensioning device to the tape moving means and for injecting tape received by the input port into the reservoir.

2. Apparatus as in claim 1 comprising means for varying tension in tape between the reservoir and the triangular-shaped device.

3. Apparatus as in claim 2 wherein means for varying tension comprise a spring.

4. Apparatus as in claim 1 wherein the reservoir comprises a plurality of guides disposed about the tape within the reservoir, the guides being disposed between the input port and the output port in an aligned relationship with tape flow through the reservoir and being separated an increasing distance from the tape in the direction of tape flow.

5. Apparatus as in claim 1 wherein said tape moving means comprise a pair of gears disposed about the tape and within the input port.

6. Apparatus as in claim 5 comprising means operatively coupled to each of the pair of gears for directing the tape into the reservoir.

7. Apparatus as in claim 1 wherein the tape is an inked ribbon.

8. Apparatus as in claim 1 wherein the tape is magnetic tape.

9. Apparatus as in claim 1 wherein the tape is photographic film.

* * * * *